US011322169B2

(12) United States Patent
Koizumi et al.

(10) Patent No.: US 11,322,169 B2
(45) Date of Patent: May 3, 2022

(54) TARGET SOUND ENHANCEMENT DEVICE, NOISE ESTIMATION PARAMETER LEARNING DEVICE, TARGET SOUND ENHANCEMENT METHOD, NOISE ESTIMATION PARAMETER LEARNING METHOD, AND PROGRAM

(71) Applicant: NIPPON TELEGRAPH AND TELEPHONE CORPORATION, Chiyoda-ku (JP)

(72) Inventors: Yuma Koizumi, Musashino (JP); Shoichiro Saito, Musashino (JP); Kazunori Kobayashi, Musashino (JP); Hitoshi Ohmuro, Musashino (JP)

(73) Assignee: NIPPON TELEGRAPH AND TELEPHONE CORPORATION, Chiyoda-ku (JP)

( * ) Notice: Subject to any disclaimer, the term of this patent is extended or adjusted under 35 U.S.C. 154(b) by 197 days.

(21) Appl. No.: 16/463,958

(22) PCT Filed: Sep. 12, 2017

(86) PCT No.: PCT/JP2017/032866
§ 371 (c)(1),
(2) Date: May 24, 2019

(87) PCT Pub. No.: WO2018/110008
PCT Pub. Date: Jun. 21, 2018

(65) Prior Publication Data

US 2020/0388298 A1 Dec. 10, 2020

(30) Foreign Application Priority Data

Dec. 16, 2016 (JP) ..... JP2016-244169

(51) Int. Cl.
*G10L 21/0216* (2013.01)
*G10L 21/0232* (2013.01)
(Continued)

(52) U.S. Cl.
CPC ..... *G10L 21/0232* (2013.01); *G10L 21/0264* (2013.01); *G10L 2021/02082* (2013.01); *G10L 2021/02165* (2013.01)

(58) Field of Classification Search
CPC ..... G10L 21/0208; G10L 21/0232; G10L 2021/02165; G10L 2021/02166; G10K 11/16; H04M 9/082
See application file for complete search history.

(56) References Cited

U.S. PATENT DOCUMENTS 8,174,932 B2 * 5/2012 Lee ..... G01S 5/28 367/127
2005/0276419 A1 * 12/2005 Eggert ..... G01S 3/8034 381/17

(Continued)

OTHER PUBLICATIONS

International Search Report dated Nov. 21, 2017 in PCT/JP2017/032866 filed on Sep. 12, 2017.

(Continued)

*Primary Examiner* — Feng-Tzer Tzeng
(74) *Attorney, Agent, or Firm* — Oblon, McClelland, Maier & Neustadt, L.L.P.

(57) ABSTRACT

A noise estimation parameter learning device is provided according to which even in a large space causing a problem of the reverberation and the time frame difference, multiple microphones disposed at distant positions cooperate with each other, and a spectral subtraction method is executed, thereby allowing the target sound to be enhanced. A noise estimation parameter learning device for learning noise estimation parameters used to estimate noise included in observed signals through a plurality of microphones, the noise estimation parameter learning device comprising: a modeling part that models a probability distribution of observed signals of the predetermined microphone, models a probability distribution of time frame differences, and models a probability distribution of transfer function gains; a likelihood function setting part that sets a likelihood function pertaining to the time frame difference, and a likelihood function pertaining to the transfer function gain, based on the modeled probability distributions; and a parameter update part that alternately and repetitively updates two variables of two likelihood functions, and outputs the time frame difference and the transfer function gain that have converged, as the noise estimation parameters.

15 Claims, 8 Drawing Sheets

(51) Int. Cl.
*G10L 21/0264* (2013.01)
*G10L 21/0208* (2013.01)

(56) References Cited

U.S. PATENT DOCUMENTS

2006/0222184 A1* 10/2006 Buck ..... G10L 21/0208
381/71.1
2008/0280653 A1* 11/2008 Ma ..... H04M 9/082
455/569.1
2012/0310637 A1* 12/2012 Vitte ..... G10L 21/0208
704/226
2014/0286497 A1* 9/2014 Thyssen ..... H04R 3/005
381/66
2016/0134984 A1* 5/2016 Erkelens ..... G10L 21/0232
381/56

OTHER PUBLICATIONS

Boll, S. F., "Suppression of Acoustic Noise in Speech Using Spectral Subtraction," IEEE Transactions on Acoustics, Speech, and Signal Processing, vol. ASSP-27, No. 2, Apr. 1979, pp. 113-120.
Higuchi, T. et al., "Joint Audio Source Separation and Dereverberation Based on Multichannel Factorial Hidden Markov Model," IEEE International Workshop on Machine Learning for Signal Processing, Sep. 2014, 6 total pages.
Asoh, H. et al., "Deep Learning," the Japanese Society for Artificial Intelligence, Kindai kagaku sha, 2015, p. 145, 5 total pages (with Partial English Translation).

* cited by examiner

TARGET SOUND ENHANCEMENT DEVICE, NOISE ESTIMATION PARAMETER LEARNING DEVICE, TARGET SOUND ENHANCEMENT METHOD, NOISE ESTIMATION PARAMETER LEARNING METHOD, AND PROGRAM

TECHNICAL FIELD

The present invention relates to a technique that causes multiple microphones disposed at distant positions to cooperate with each other in a large space and enhances a target sound, and relates to a target sound enhancement device, a noise estimation parameter learning device, a target sound enhancement method, a noise estimation parameter learning method, and a program.

BACKGROUND ART

Beamforming using a microphone array is a typical technique of suppressing noise arriving in a certain direction. To collect sounds of sports for broadcasting purpose, instead of use of beamforming, a directional microphone, such as a shotgun microphone or a parabolic microphone, is often used. In each technique, a sound arriving in a predetermined direction is enhanced, and sounds arriving in the other directions are suppressed.

A situation is discussed where in a large space, such as a ballpark, a soccer ground, or a manufacturing factory, only a target sound is intended to be collected. Specific examples include collection of batting sounds and voices of umpires in a case of a ballpark, and collection of operation sounds of a certain manufacturing machine in a case of a manufacturing factory. In such an environment, noise sometimes arrives in the same direction as that of the target sound. Accordingly, the technique described above cannot only enhance the target sound.

Techniques of suppressing noise arriving in the same direction as that of the target sound include time-frequency masking. Hereinafter, such methods are described using formulae. Upper right numerals of X representing an observed signal and H representing transfer characteristics, which appear in the following formulae, are assumed to mean the identification numbers (indices) of corresponding microphones. For example, in a case where the upper right numeral is (1), the corresponding microphone is assumed to be "first microphone". The "first microphone" appearing in the following description is assumed to be a predetermined microphone for always observing a target sound. That is, an observed signal $X^{(1)}$ observed by the "first microphone" is assumed to be a predetermined observed signal that always includes the target sound, and is assumed to be an observed signal appropriate for a signal used for sound source enhancement.

Meanwhile, in the following description, the "m-th microphone" also appears. Representation of the "m-th microphone" means a "freely selected microphone" with respect to the "first microphone".

Consequently, in the cases of the "first microphone" and the "m-th microphone", the identification numbers are conceptual. There is no possibility that the position and characteristics of the microphone are identified by the identification number. For example, in the case of a ballpark, representation of the "first microphone" does not mean that the microphone resides at a predetermined position, such as "behind the plate", for example. The "first microphone" means the predetermined microphone suitable for observation of the target sound. Consequently, when the position of the target sound moves, the position of the "first microphone" moves accordingly (more correctly, the identification number (index) assigned to the microphone is appropriately changed according to the movement of the target sound).

First, an observed signal collected by beamforming or a directional microphone is assumed to be $X^{(1)}_{\omega,\tau} \in C^{\Omega \times T}$. Here, $\omega \in \{1, \ldots, \Omega\}$ and $\tau \in \{1, \ldots, T\}$ are the indices of the frequency and time, respectively. In a case where the target sound is assumed as $S^{(1)}_{\omega,\tau} \in C^{\Omega \times T}$ and a noise group having not sufficiently been suppressed is assumed as $N_{\omega,\tau} \in C^{\Omega \times 1}$, the observed signal can be described as follows.

[Formula 1]

$$X_{\omega,\tau}^{(1)} = H_{\omega}^{(1)} S_{\omega,\tau}^{(1)} + N_{\omega,\tau} \tag{1}$$

Here, $H_{\omega}^{(1)}$ is the transfer characteristics from the target sound position to the microphone position. Formula (1) shows that the observed signal of the predetermined (first) microphone includes the target sound and noise. Time-frequency masking obtains a signal $Y_{\omega,\tau}$ including an enhanced target sound, using the time-frequency mask Here, an ideal time-frequency mask $G_{\omega,\tau}$^{ideal} can be obtained by the following formula.

[Formula 2]

$$G_{\omega,\tau}^{ideal} = \frac{|H_{\omega}^{(1)} S_{\omega,\tau}^{(1)}|}{|H_{\omega}^{(1)} S_{\omega,\tau}^{(1)}| + |N_{\omega,\tau}|} \tag{2}$$

$$Y_{\omega,\tau} = G_{\omega,\tau}^{ideal} X_{\omega,\tau}^{(1)} \tag{3}$$

However, $|H_{\omega}^{(1)} S^{(1)}_{\omega,\tau}|$ and $|N_{\omega,\tau}|$ are unknown. Accordingly, these terms are required to be estimated using the observed signal and other information.

The time-frequency masking based on the spectral subtraction method is a method that is used if $|N^{[<]BEGINITALm}_{\omega,\tau}|$ can be estimated by a certain way. The time-frequency mask is determined as follows using the estimated $|N^{[<]BEGINITALm}_{\omega,\tau}|$.

[Formula 3]

$$G_{\omega,\tau} = \frac{|X_{\omega,\tau}^{(1)}| - |\hat{N}_{\omega,\tau}|}{|X_{\omega,\tau}^{(1)}|} \approx \frac{|H_{\omega}^{(1)} S_{\omega,\tau}^{(1)}|}{|H_{\omega}^{(1)} S_{\omega,\tau}^{(1)}| + |N_{\omega,\tau}|} \tag{4}$$

$$Y_{\omega,\tau} = G_{\omega,\tau} X_{\omega,\tau}^{(1)} \tag{5}$$

A typical method of estimating $|N^{[<]BEGINITALm}_{\omega,\tau}|$ is a method of using a stationary component of $|X^{(1)}_{\omega,\tau}|$ (Non-patent Literature 1). However, $N_{\omega,\tau} \in C^{\Omega \times T}$ includes non-stationary noise, such as drumming sounds in a sport field, and riveting sounds in a factory. Consequently, $|N_{\omega,\tau}|$ is required to be estimated by another method.

A method of intuitively estimating $|N_{\omega,\tau}|$ may be a method of directly observing noise through a microphone. It seems that in a case of a ballpark, a microphone is attached in the outfield stand, and cheers $|X^{(m)}_{\omega,\tau}|$ are collected and corrected, as follows, assuming instantaneous mixture, and $|N^{[<]BEGINITALm}_{\omega,\tau}|$ is obtained.

[Formula 4]

$$|\hat{N}_{\omega,\tau}| = \sum_{m=2}^{M} |H_{\omega}^{(m)}||X_{\omega,\tau}^{(m)}| \tag{6}$$

Here, $H_{\omega}^{(m)}$ is the transfer characteristics from an m-th microphone to a microphone serving as a main one.

PRIOR ART LITERATURE

Non-Patent Literature

Non-patent Literature 1: S. Boll, "Suppression of acoustic noise in speech using spectral subtraction", IEEE Trans. ASLP, 1979.

SUMMARY OF THE INVENTION

Problems to be Solved by the Invention

Unfortunately, to remove noise using multiple microphones disposed at positions sufficiently apart from each other in a large space, such as a sport field, there are two problems as follows.

<Reverberation Problem>

In a case where the sampling frequency is 48.0 [kHz] and the analysis width of short-time Fourier transform (STFT) is 512, the time length of reverberation (impulse response) that can be described as instantaneous mixture is 10 [ms]. Typically, the reverberation time period in a sport field or a manufacturing factory is equal to or longer than this time length. Consequently, a simple instantaneous mixture model cannot be assumed.

<Time Frame Difference Problem>

For example, in a ballpark, the outfield stand and the home plate are apart from each other by about 100 [m]. In a case where the sonic speed is C=340 [m/s], cheers on the outfield stand arrives about 300 [ms] later. In a case where the sampling frequency is 48.0 [kHz] and the STFT shift width is 256, a time frame difference

[Formula 5]

$$P \approx 60$$

occurs. Owing to this time frame difference, a simple spectral subtraction method cannot be executed.

Accordingly, the present invention has an object to provide a noise estimation parameter learning device according to which even in a large space causing a problem of the reverberation and the time frame difference, multiple microphones disposed at distant positions cooperate with each other, and a spectral subtraction method is executed, thereby allowing the target sound to be enhanced.

Means to Solve the Problems

A noise estimation parameter learning device according to the present invention is a device of learning noise estimation parameters used to estimate noise included in observed signals through a plurality of microphones, the noise estimation parameter learning device comprising: a modeling part; a likelihood function setting part; and a parameter update part.

The modeling part models a probability distribution of observed signals of the predetermined microphone among the plurality of microphones, models a probability distribution of time frame differences caused according to a relative position difference between the predetermined microphone, the freely selected microphone and the noise source, and models a probability distribution of transfer function gains caused according to the relative position difference between the predetermined microphone, the freely selected microphone and the noise source.

The likelihood function setting part sets a likelihood function pertaining to the time frame difference, and a likelihood function pertaining to the transfer function gain, based on the modeled probability distributions.

The parameter update part alternately and repetitively updates a variable of the likelihood function pertaining to the time frame difference and a variable of the likelihood function pertaining to the transfer function gain, and outputs the converged time frame difference and the transfer function gain, as the noise estimation parameters.

Effects of the Invention

According to the noise estimation parameter learning device of the present invention, even in a large space causing a problem of the reverberation and the time frame difference, multiple microphones disposed at distant positions cooperate with each other, and a spectral subtraction method is executed, thereby allowing the target sound to be enhanced.

DETAILED DESCRIPTION OF THE EMBODIMENTS

Embodiments of the present invention are hereinafter described in detail. Components having the same functions are assigned the same numerals, and redundant description is omitted.

Embodiment 1

Embodiment 1 solves the two problems. Embodiment 1 provides a technique of estimating the time frame difference and reverberation so as to cause microphones disposed at positions far apart in a large space to cooperate with each other for sound source enhancement. Specifically, the time frame difference and the reverberation (transfer function gain (Note *1)) are described in a statistical model, and are estimated with respect to a likelihood maximization reference for an observed signal. To model the reverberation that is caused by a distance sufficiently apart and cannot be described by instantaneous mixture, modeling is performed by convolution of the amplitude spectrum of the sound source and the transfer function gain in the time-frequency domain.

(Note *1) The reverberation can be described as a transfer function in the frequency domain, and the gain thereof is called a transfer function gain.

Figure 1:
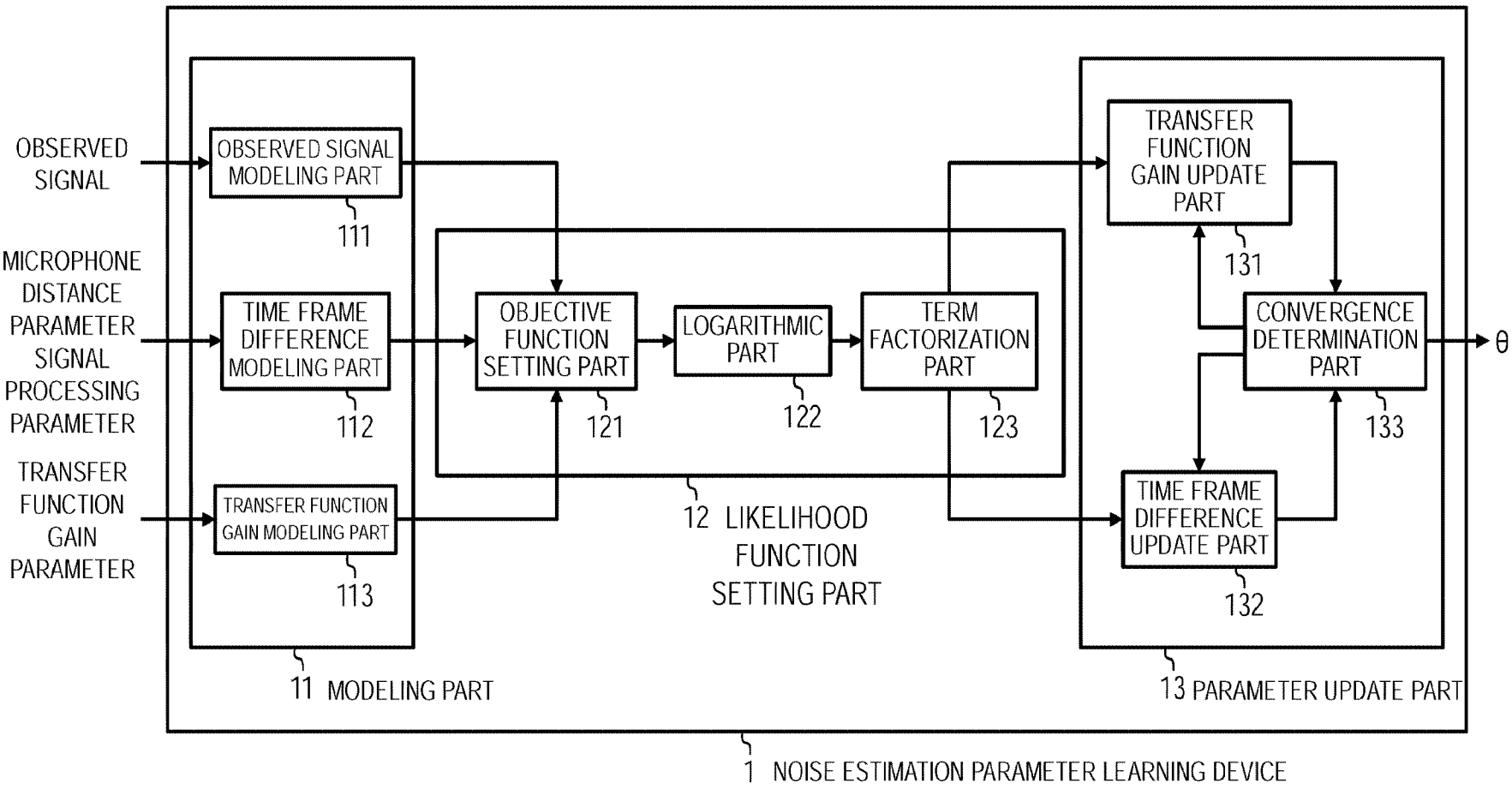
FIG. 1 is a block diagram showing a configuration of a noise estimation parameter learning device of Embodiment 1.

Hereinafter, referring to FIG. 1, a noise estimation parameter learning device in Embodiment 1 is described. As shown in FIG. 1, the noise estimation parameter learning device 1 in this embodiment includes a modeling part 11, a likelihood function setting part 12, and a parameter update part 13. In more detail, the modeling part 11 includes an observed signal modeling part 111, a time frame difference modeling part 112, and a transfer function gain modeling part 113. The likelihood function setting part 12 includes an objective function setting part 121, a logarithmic part 122, and a term factorization part 123. The parameter update part 13 includes a transfer function gain update part 131, a time frame difference update part 132, and a convergence determination part 133.

Figure 2:
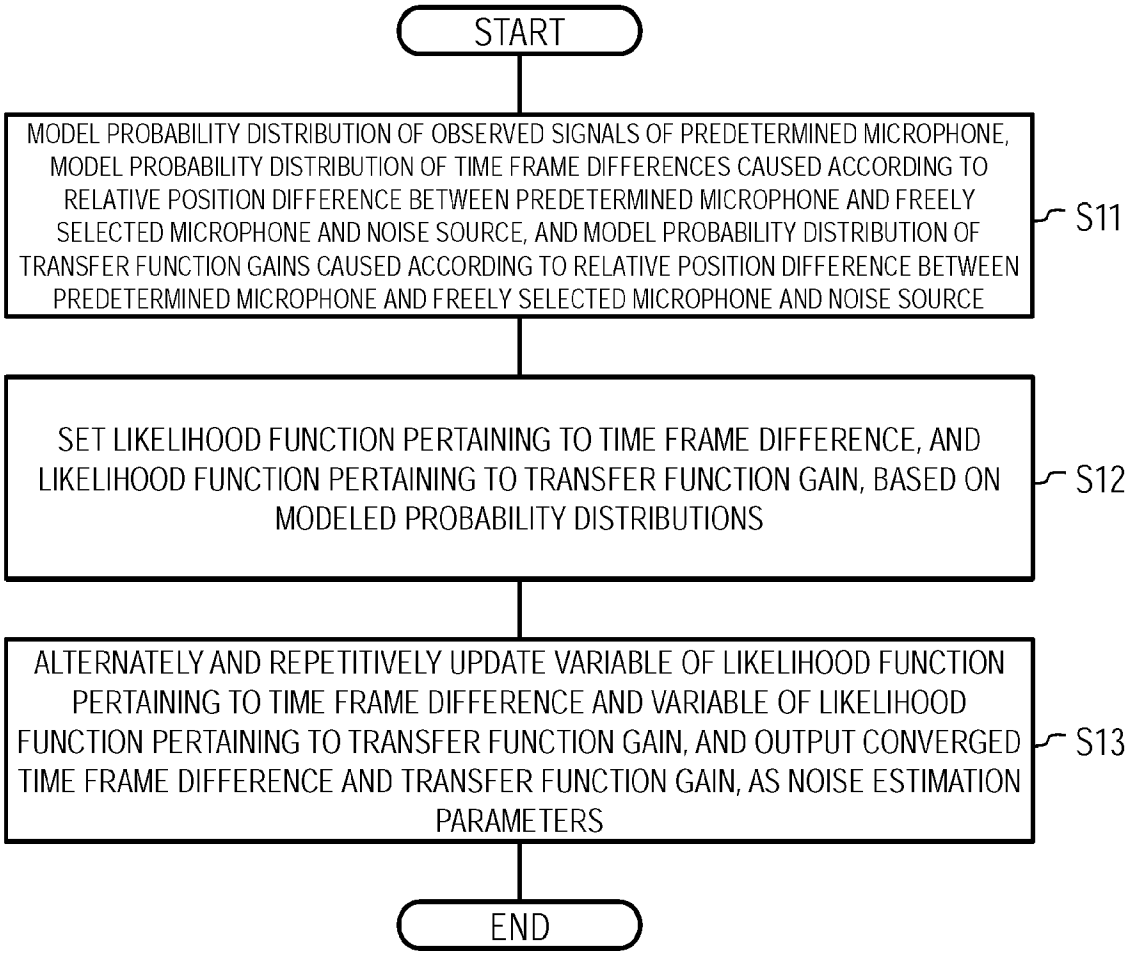
FIG. 2 is a flowchart showing an operation of the noise estimation parameter learning device of Embodiment 1.

Hereinafter, referring to FIG. 2, an overview of the operation of the noise estimation parameter learning device 1 in this embodiment is described.

First, the modeling part 11 models the probability distribution of observed signals of a predetermined microphone (first microphone) among the plurality of microphones, models the probability distribution of time frame differences caused according to the relative position difference between the predetermined microphone, a freely selected microphone (m-th microphone) and a noise source, and models the probability distribution of transfer function gains caused according to the relative position difference between the predetermined microphone, the freely selected microphone and the noise source (S11).

Next, the likelihood function setting part 12 sets a likelihood function pertaining to the time frame difference, and a likelihood function pertaining to the transfer function gain, based on the modeled probability distributions (S12).

Next, the parameter update part 13 alternately and repetitively updates a variable of the likelihood function pertaining to the time frame difference and a variable of the likelihood function pertaining to the transfer function gain, and outputs the time frame difference and the transfer function gain that have converged, as the noise estimation parameters (S13).

To describe the operation of the noise estimation parameter learning device 1 in further detail, required description is made in the following chapter <Preparation>.

<Preparation>

Now, an issue of estimating a target sound $S^{(1)}_{\omega,\tau}$ from observation through M microphones (M is an integer of two or more) is discussed. One or more of the microphones are assumed to be disposed (Note *2) at positions sufficiently apart from a microphone serving as a main one.

(Note *2) a distance causing an arrival time difference equal to or more than the shift width of the short-time Fourier transform (STFT). That is, a distance causing the time frame difference in time-frequency analysis. For example, in a case where the microphone interval is 2 [m] or more with the sonic speed of C=340 [m/s], the sampling frequency of 48.0 [kHz] and the STFT shift width of 512, the time frame difference occurs. That is, this means that the observed signal is a signal obtained by frequency-transforming an acoustic signal collected by the microphone, and the difference of two arrival times is equal to or more than the shift width of the frequency transformation, the arrival times being the arrival time of the noise from the noise source to the predetermined microphone and the arrival time of the noise from the noise source to the freely selected microphone.

The identification number of the predetermined microphone disposed closest to $S^{(1)}_{\omega,\tau}$ is assumed as one. Its observed signal $X^{(1)}_{\omega,\tau}$ is assumed to be obtained by Formula (1). It is assumed that in a space there are M−1 point noise sources (e.g., public-address announcement) or a group of point noise sources (e.g., the cheering by supporters)

[Formula 6]

$$S_{\omega,\tau}^{(2,\ldots,M)}$$

It is also assumed that the m-th microphone is disposed adjacent to the m-th (m=2, . . . ,M) noise source. It is assumed that adjacent to the m-th microphone,

[Formula 7]

$$|S_{\omega,\tau}^{(m)}|>>|S_{\omega,\tau}^{(1,\ldots,M,\neq m)}|$$

holds. It is also assumed that the observed signal $X^{(m)}_{\omega,\tau}$ can be approximately described as

[Formula 8]

$$X_{\omega,\tau}^{(m)}\approx S_{\omega,\tau}^{(m)} \tag{7}$$

Formula (7) shows that the observed signal of the freely selected (m-th) microphone includes noise. It is assumed that the noise $N_{\omega,\tau}$ reaching the first microphone consists only of

[Formula 9]

$$S_{\omega,\tau}^{(2,\ldots,M)}$$

The amplitude spectrum thereof can be approximately described as follows.

[Formula 10]

$$|N_{\omega,\tau}|\approx\sum_{m=2}^{M}\sum_{k=0}^{K}a_{\omega,k}^{(m)}|X_{\omega,\tau-P_m-k}^{(m)}| \tag{8}$$

Here, $P_m\in N_+$ is the time frame difference in the time-frequency domain, the difference being caused according to the relative position difference between the first microphone, the m-th microphone and the noise source $S(m)_{\omega,\tau}$. Here, $a^{(m)}_{\omega,k}\in R_+$ is the transfer function gain, which is caused according to the relative position difference between the first microphone, the m-th microphone and the noise source $S^{(m)}_{\omega,\tau}$.

Hereinafter, description of the reverberation due to convolution between the amplitude spectrum of the sound source

[Formula 11]

$$|X_{\omega,\tau-P_m-k}^{(m)}|$$

and the transfer function gain $a^{(m)}_{\omega,k}$ in the time-frequency domain is illustrated in detail. In a case where the number of taps of impulse response is longer than the analysis width of short-time Fourier transform (STFT), the transfer characteristics cannot be described by instantaneous mixture in the time-frequency domain (Reference non-patent literature 1). For example, in a case where the sampling frequency is 48.0 [kHz] and the analysis width of STFT is 512, the time length of reverberation (impulse response) that can be described as instantaneous mixture is 10 [ms]. Typically, the reverberation time period in a sport field or a manufacturing factory is equal to or longer than this time length. Consequently, a simple instantaneous mixture model cannot be assumed. To describe a long reverberation approximately, the m-th sound source is assumed to arrive, with convolution of the amplitude spectrum of $X^{(m)}_{\omega,\tau}$ with the transfer function gain $a^{(m)}_{\omega,k}$ in the time-frequency domain. Reference non-patent literature 1 describes this with complex spectral convolution. The present invention describes this with an amplitude spectrum for the sake of more simple description.

(Reference non-patent literature 1: T. Higuchi and H. Kameoka, "Joint audio source separation and dereverberation based on multichannel factorial hidden Markov model", in Proc MLSP 2014, 2014.)

According to the above discussion, based on Formula (8), possible estimation of the time frame difference $P_{2,\ldots,M}$ of the noise sources and the transfer function gain

[Formula 12]

$$a_{1,\ldots,K}^{(2,\ldots,M)}$$

can, in turn, estimate the amplitude spectrum of noise. Consequently, the spectral subtraction method can be executed. That is, in this embodiment and Embodiment 2,

[Formula 13]

$$\Theta = \{a_{1,\ldots,K}^{(2,\ldots,M)}, P_{2,\ldots,M}\}$$

is estimated, and the spectral subtraction method is executed, thereby allowing the target sound to be collected in the large space.

First, it is assumed that Formula (1) holds even in the amplitude spectrum domain, and $|X^{(1)}_{\omega,\tau}|$ is approximately described as follows.

[Formula 14]

$$|X_{\omega,\tau}^{(1)}| = |S_{\omega,\tau}^{(1)}| + |N_{\omega,\tau}| \tag{9}$$

Here, to simplify the description, $H_{\omega}^{(1)}$ is omitted. To represent all frequency bins $\omega \in \{1, \ldots, \Omega\}$ and $\tau \in \{1, \ldots, T\}$ at the same time, Formula (9) is represented with the following matrix operations.

[Formula 15]

$$X_\tau^{(1)} \approx S_\tau^{(1)} + N_\tau \tag{10}$$

$$X_\tau^{(m)} \approx S_\tau^{(m)} \tag{11}$$

$$N_\tau \approx \sum_{m=2}^{M} \sum_{k=0}^{K} a_k^{(m)} \circ X_{\tau-P_m-k}^{(m)} \approx X_\tau a \tag{12}$$

Note that ° is a Hadamard product. Here,

[Formula 16]

$$X_\tau^{(i)} = (|X_{1,\tau}^{(i)}|, |X_{2,\tau}^{(i)}|, \ldots, |X_{\Omega,\tau}^{(i)}|)^T \tag{13}$$

$$S_\tau^{(i)} = (|S_{1,\tau}^{(i)}|, |S_{2,\tau}^{(i)}|, \ldots, |S_{\Omega,\tau}^{(i)}|)^T \tag{14}$$

$$N_\tau = (|N_{1,\tau}|, |N_{2,\tau}|, \ldots, |N_{\Omega,\tau}|)^T \tag{15}$$

$$a_k^{(i)} = (a_{1,k}^{(i)}, a_{2,k}^{(i)}, \ldots, a_{\Omega,k}^{(i)})^T \tag{16}$$

$$X_\tau = (X_\tau^{(2)}, \ldots, X_\tau^{(M)}) \tag{17}$$

$$X_\tau^{(m)} = (\mathrm{diag}(X_{\tau-P_m}^{(m)}), \ldots, \mathrm{diag}(X_{\tau-P_m-K}^{(m)})) \tag{18}$$

$$a = (a^{(2)}, \ldots, a^{(M)}) \tag{19}$$

$$a^{(m)} = (a_0^{(m)}, \ldots, a_K^{(m)}) \tag{20}$$

diag(x) represents a diagonal matrix having a vector x as diagonal elements. Here, $S^{(1)}_{\omega,\tau}$ is often sparse in the time frame direction (the target sound is not present almost over the time period). In a specific example, it means that soccer ball kicking sounds and voices of referees are temporally short, and rarely occur. Consequently, over the most time period,

[Formula 17]

$$X_\tau^{(1)} = N_\tau \tag{21}$$

holds.

<Detailed Operation of Modeling Part 11>

Figure 3:
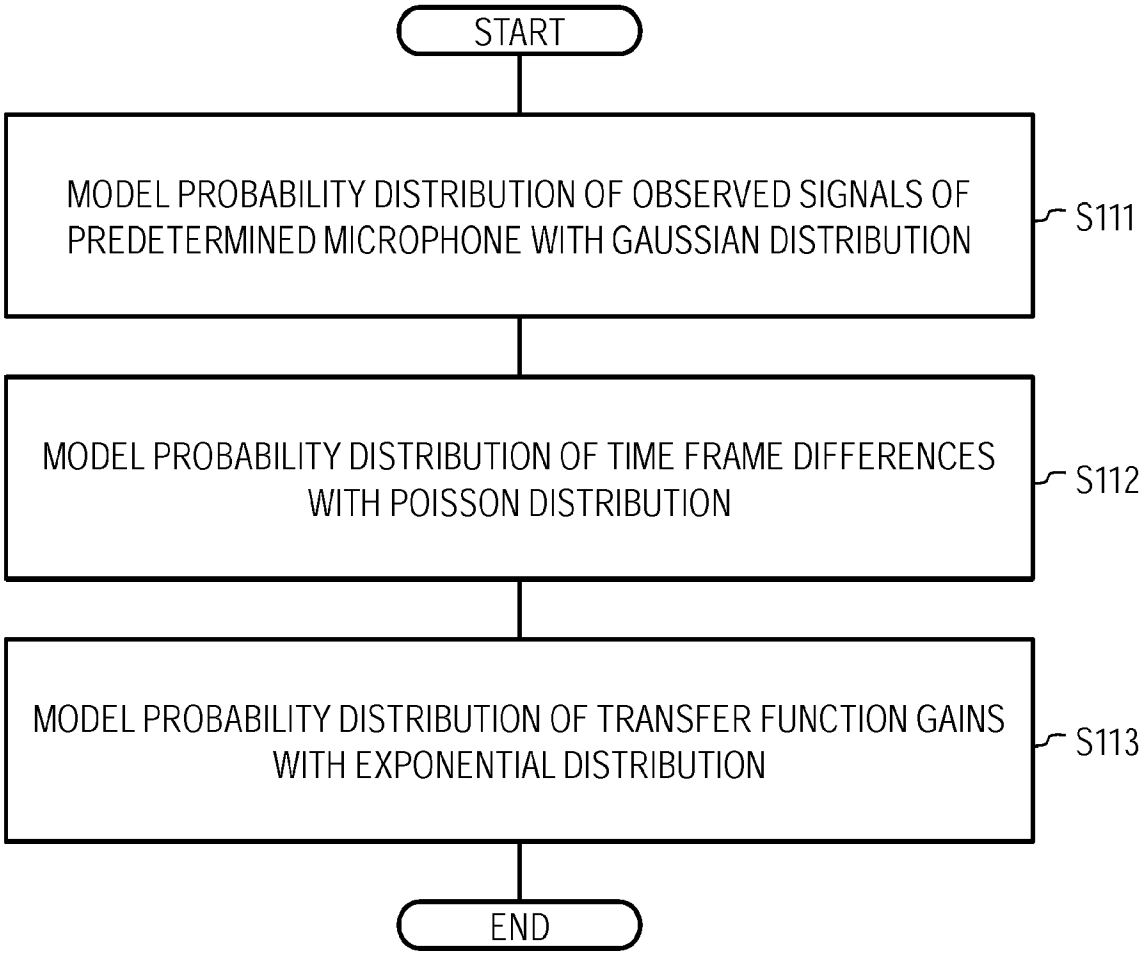
FIG. 3 is a flowchart showing an operation of a modeling part of Embodiment 1.

Hereinafter, referring to FIG. 3, the details of the operation of the modeling part 11 are described. Data required for learning is input into the observed signal modeling part 111. Specifically, the observed signal

[Formula 18]

$$X_\tau^{(1)} = N_\tau \tag{21}$$

is input.

The observed signal modeling part 111 models the probability distribution of the observed signal $X^{(1)}_\tau$ of the predetermined microphone with a Gaussian distribution where NT is the average and a covariance matrix diag(G) is adopted

[Formula 19]

$$\mathcal{N}(N_\tau, \mathrm{diag}(\sigma^2))$$

(S111).

[Formula 20]

$$X_\tau^{(1)} \sim \mathcal{N}(X_\tau^{(1)} \mid N_\tau, \mathrm{diag}(\sigma)) \tag{22}$$

$$\sim \frac{|\Lambda|^{1/2}}{(2\pi)^{\Omega/2}} \exp\left\{-\frac{1}{2}(X_\tau^{(1)} - N_\tau)^T \Lambda (X_\tau^{(1)} - N_\tau)\right\} \tag{23}$$

Here, $A = (\mathrm{diag}(\sigma))^{-1}$. $\sigma = (\sigma_1, \ldots, \sigma_\Omega)^T$ is the power of $X^{(1)}_\tau$ for each frequency, and is obtained by

[Formula 21]

$$\sigma_\omega = \frac{1}{T} \sum_{\tau=1}^{T} |X_{\omega,\tau}^{(1)}| \tag{24}$$

This is for the sake of correcting the difference of averages of amplitudes for the frequencies.

The observed signal may be transformed from the time waveform into the complex spectrum using a method, such as STFT. As for the observed signal, in a case of batch learning, $X^{(m)}_{\omega,\tau}$ for M channels obtained by applying short-time Fourier transform to learning data is input. In a case of online learning, what is obtained by buffering data for T frames is input. Here, the buffer size is to be tuned according to the time frame difference and the reverberation length, and may be set to be about T=500.

Microphone distance parameters, and signal processing parameters are input into the time frame difference modeling part 112. The microphone distance parameters include microphone distances $\phi_{2,\ldots,M}$, and the minimum value and the maximum value of the sound source distance estimated from the microphone distances $\phi_{2,\ldots,M}$

[Formula 22]

$$\phi_{2,\ldots,M}^{min},\phi_{2,\ldots,M}^{max}$$

The signal processing parameters include the number of frames K, the sampling frequency $f_s$, the STFT analysis width, and the shift length $f_{shift}$ Here, K=15 and therearound are recommended. The signal processing parameters may be set in conformity with the recording environment. When the sampling frequency is 16.0 [kHz], the analysis width may be set to be about 512, and the shift length may be set to be about 256.

The time frame difference modeling part 112 models the probability distribution of the time frame differences with a Poisson distribution (S112). In a case where the m-th microphone is disposed adjacent to the m-th noise source, $P_m$ can be approximately estimated by the distances between the first microphone and the m-th microphone. That is, provided that the distance between the first microphone and the m-th microphone is $\phi_m$, the sonic speed is C, the sampling frequency is f and the STFT shift width is $f_{shift}$, the time frame difference $D_m$ is approximately obtained by

[Formula 23]

$$D_m = \text{round}\left\{\frac{\phi_m}{C}\cdot\frac{f_s}{f_{shift}}\right\} \tag{25}$$

Here, round{•} indicates rounding off to an integer. However, in actuality, the distance between the m-th microphone and the m-th noise source is not zero. Consequently, $P_m$ may stochastically fluctuate in proximity to $D_m$. To model this, the time frame difference modeling part 112 models the probability distribution of the time frame difference with a Poisson distribution having the average value $D_m$ (S112).

[Formula 24]

$$\begin{aligned} P_m &\sim \text{Poisson}(P_m \mid D_m) \\ &\sim \frac{D_m^{P_m}}{P_m!}\exp\{-D_m\} \end{aligned} \tag{26}$$

Transfer function gain parameters are input into the transfer function gain modeling part 113. The transfer function gain parameters include the initial value of the transfer function gain,

[Formula 25]

$$a_{1,\ldots,\Omega,1,\ldots,K}^{(2,\ldots,M)}$$

the average value $\alpha_k$ of the transfer function gain, the time attenuation weight β of the transfer function gain, and the step size λ. If there is any knowledge, the initial value of the transfer function gain may be set accordingly. On the contrary, without any knowledge, the value may be set to

[Formula 26]

$$a_{1,\ldots,\Omega,1,\ldots,K}^{(2,\ldots,M)}=1.0$$

Likewise, if there is any knowledge, $\alpha_k$ may be set accordingly. Without any knowledge, to reduce $\alpha_k$ according to frame passage, $\alpha_k$ may be set as follows.

[Formula 27]

$$\alpha_k=\max(\alpha-\beta k,\varepsilon) \tag{27}$$

Here, α is the value of $\alpha_0$, β is the attenuation weight according to frame passage, and ε is a small coefficient for preventing division by zero. As various parameters, α=1.0 or therearound, β=0.05, and $\lambda=10^{-3}$ or therearound are recommended.

The transfer function gain modeling part 113 models the probability distribution of the transfer function gains with an exponential distribution (S113). $a^{(m)}_{\omega,k}$ is a positive real number. In general, the value of the transfer function gain increases with increase in time k. To model this, the transfer function gain modeling part 113 models the probability distribution of the transfer function gains with an exponential distribution having the average value $\alpha_k$ (S113).

[Formula 28]

$$\begin{aligned} a_{\omega,k}^{(m)} &\sim \text{Exponential}(a_{\omega,k}^{(m)} \mid \alpha_k) \\ &\sim \frac{1}{\alpha_k}\exp\left\{-\frac{a_{\omega,k}^{(m)}}{\alpha_k}\right\} \end{aligned} \tag{28}$$

As described above, the probability distributions for the observed signal and each parameter can be defined. In this embodiment, the parameters are estimated by maximizing the likelihood.

<Detailed Operation of Likelihood Function Setting Part 12>

Figure 4:
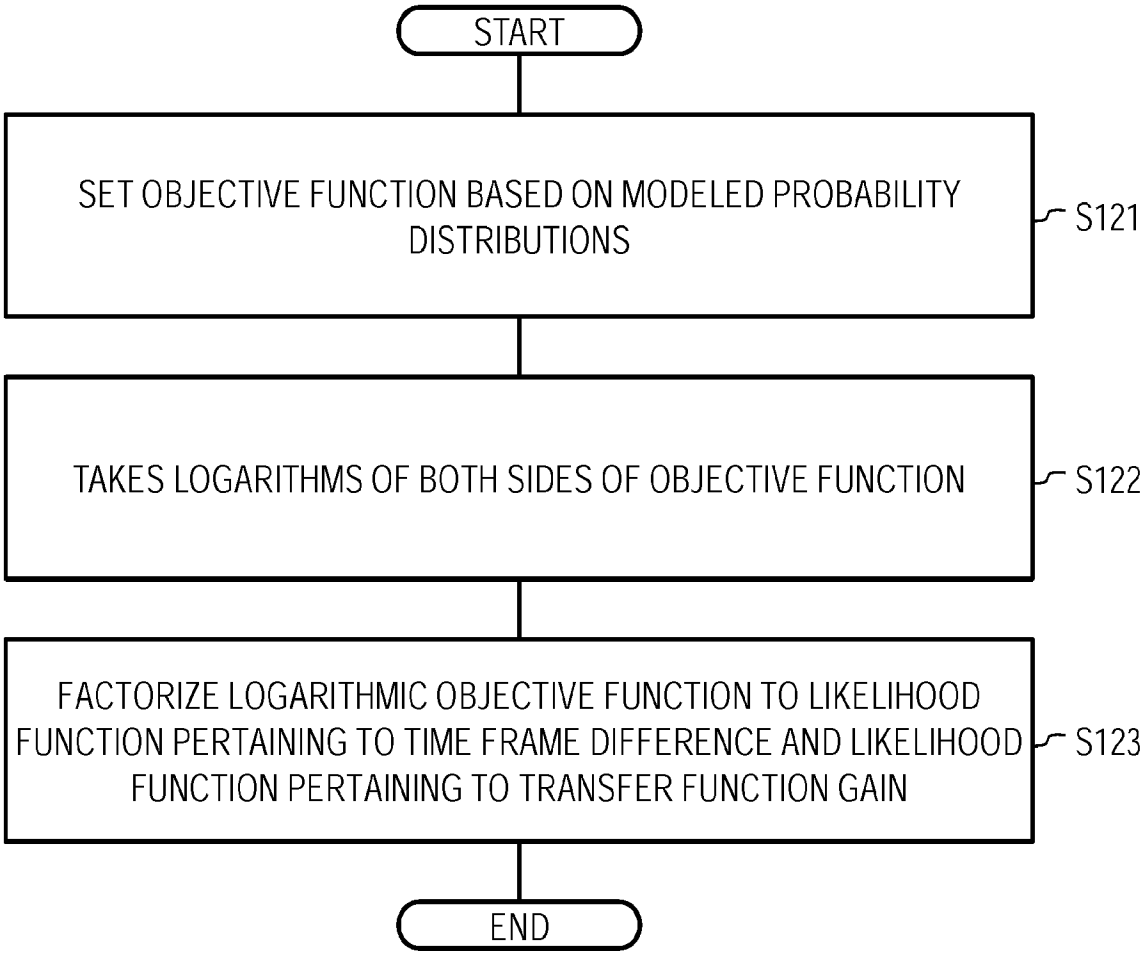
FIG. 4 is a flowchart showing an operation of a likelihood function setting part of Embodiment 1.

Hereinafter, referring to FIG. 4, the details of the operation of the likelihood function setting part 12 are described. Specifically, the objective function setting part 121 sets the objective function as follows, on the basis of the modeled probability distribution (S121).

[Formula 29]

$$L = p(X_{1,\ldots,T},\Theta) \tag{29}$$

$$= p(X_{1,\ldots,T}\mid\Theta)p(a_{1,\ldots,K}^{(2,\ldots,M)})p(P_{2,\ldots,M}) \tag{30}$$

$$p(X_{1,\ldots,T}\mid\Theta) = \prod_{\tau=1}^{T}\mathcal{N}(X_\tau^{(1)}\mid N_\tau,\text{diag}(\sigma)) \tag{31}$$

$$p(a_{1,\ldots,K}^{(2,\ldots,M)}) = \prod_{\omega=1}^{Q}\prod_{m=2}^{M}\prod_{k=1}^{K}\text{Exponential}(a_{\omega,k}^{(m)}\mid\alpha_k) \tag{32}$$

$$p(P_{2,\ldots,M}) = \prod_{m=2}^{M}\text{Poisson}(P_m\mid D_m) \tag{33}$$

Here,

[Formula 30]

$$a_{1,\ldots,K}^{(2,\ldots,M)}$$

is required to have a nonnegative value. Consequently, this optimization is a multivariable maximization problem with a limitation of L as follows.

[Formula 31]

$$\Theta \leftarrow \arg\max_{\Theta} L \text{ subject to } 0 \leq a_{1,\ldots,\Omega,1,\ldots,K}^{(2,\ldots,M)} \tag{34}$$

Here, L has a form of a product of probability value. Consequently, there is a possibility that underflow occurs during calculation. Accordingly, the fact that a logarithmic function is a monotonically increasing function is used, and the logarithms of both sides are taken. Specifically, the logarithmic part 122 takes logarithms of both sides of the objective function, and transforms Formulae (34) and (33) as follows (S122).

[Formula 32]

$$\Theta \leftarrow \arg\max_{\Theta} \mathcal{L} \text{ subject to } 0 \leq a_{1,\ldots,\Omega,1,\ldots,K}^{(2,\ldots,M)} \tag{35}$$

$$\mathcal{L} = \ln p(X_{1,\ldots,T} \mid \Theta) + \ln p(a_{1,\ldots,K}^{(2,\ldots,M)}) + \ln p(P_{2,\ldots,M}) \tag{36}$$

Here,

[Formula 33]

$$\mathcal{L} = \ln(L)$$

Each element can be described as follows.

[Formula 34]

$$\ln p(X_{1,\ldots,T} \mid \Theta) \propto -\frac{1}{2}\sum_{\tau=1}^{T} (X_\tau^{(1)} - X_\tau a)^T \Lambda (X_\tau^{(1)} - X_\tau a) \tag{37}$$

$$\ln p(a_{1,\ldots,K}^{(2,\ldots,M)}) \propto \sum_{\omega=1}^{\Omega}\sum_{m=2}^{M}\sum_{k=1}^{K} -\ln \alpha_k - \frac{a_k^{(m)}}{\alpha_k} \tag{38}$$

$$\ln p(P_{2,\ldots,M}) \propto \sum_{m=2}^{M} -\ln(P_m!) + P_m \ln(D_m) - D_m \tag{39}$$

The above transformation facilitates maximization of each likelihood function constituting

[Formula 35]

$$\mathcal{L}$$

Formula (35) achieves maximization using the coordinate descent (CD) method. Specifically, the term factorization part 123 factorizes the likelihood function (logarithmic objective function) to a term related to a (a term related to the transfer function gain), and a term related to P (a term related to the time frame difference) (S123).

[Formula 36]

$$\mathcal{L}_a = \ln p(X_{1,\ldots,T} \mid \Theta) + \ln p(a_{1,\ldots,K}^{(2,\ldots,M)}) \tag{40}$$

$$\mathcal{L}_P = \ln p(X_{1,\ldots,T} \mid \Theta) + \ln p(P_{(2,\ldots,M)}) \tag{41}$$

Alternate optimization of each variable (repetitive update) approximately maximizes

[Formula 37]

$$\mathcal{L}$$

[Formula 38]

$$a_{1,\ldots,K}^{(2,\ldots,M)} \leftarrow \arg\max_{\Theta} \mathcal{L}_a \text{ subject to } 0 \leq a_{1,\ldots,\Omega,1,\ldots,K}^{(2,\ldots,M)} \tag{42}$$

$$P_{2,\ldots,M} \leftarrow \arg\max_{\Theta} \mathcal{L}_P \tag{43}$$

Formula (42) is optimization with the limitation. Accordingly, the optimization is achieved using the proximal gradient method.

<Detailed Operation of Parameter Update Part 13>

Figure 5:
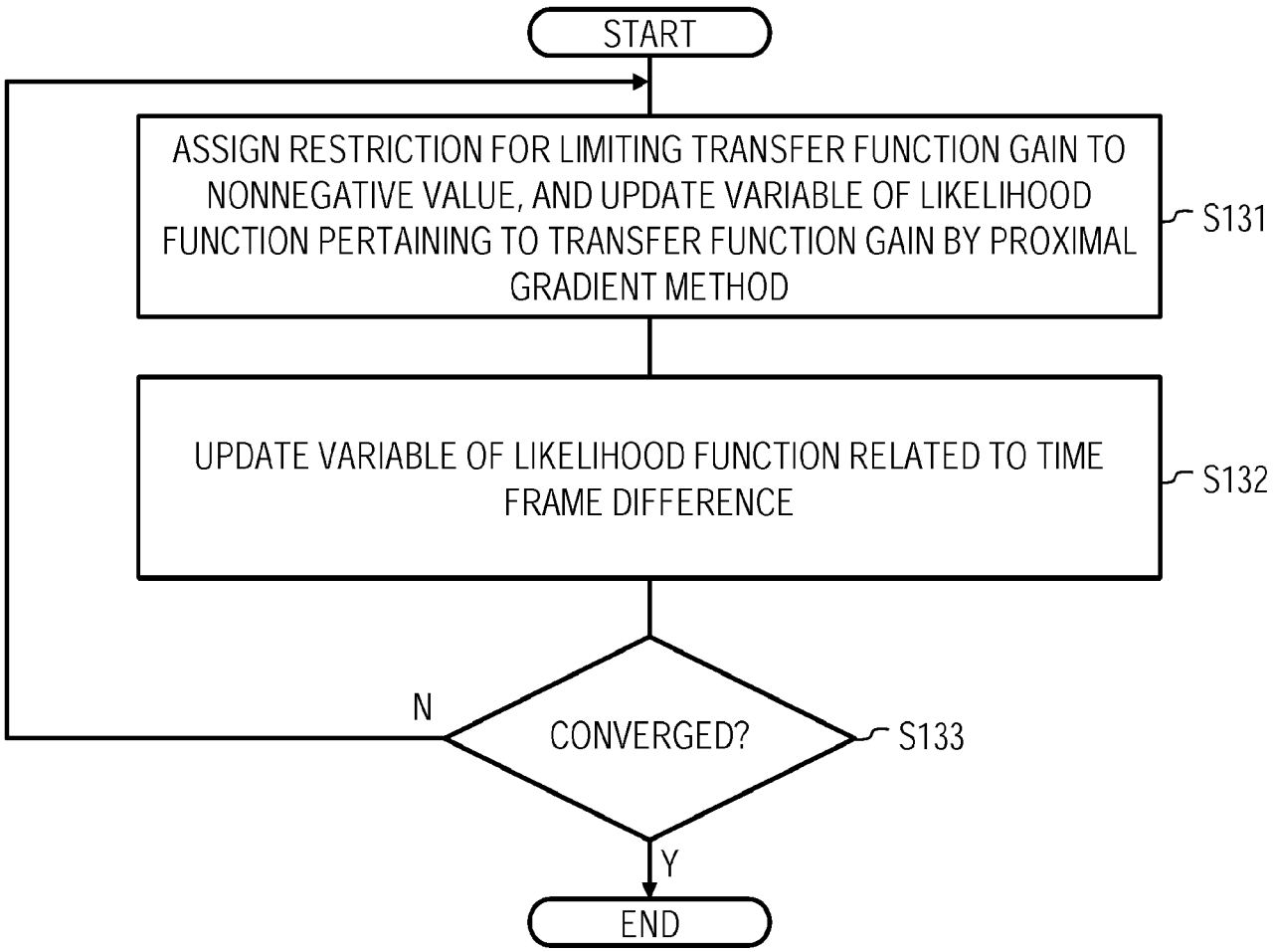
FIG. 5 is a flowchart showing an operation of a parameter update part of Embodiment 1.

Hereinafter, referring to FIG. 5, the details of the operation of the parameter update part 13 are described. The transfer function gain update part 131 assigns a restriction that limits the transfer function gain to a nonnegative value, and repetitively updates the variable of the likelihood function pertaining to the transfer function gain by the proximal gradient method (S131).

In more detail, the transfer function gain update part 131 obtains the gradient vector of

[Formula 39]

$$\mathcal{L}_a \text{ with respect to } a$$

by the following formula.

[Formula 40]

$$\frac{\partial \mathcal{L}_a}{\partial a} = \frac{1}{T}\sum_{\tau=1}^{T} X_\tau^T \Lambda(-X_\tau^{(1)} + X_\tau a) - \alpha \tag{44}$$

$$\alpha = (\underbrace{\tilde{\alpha}, \tilde{\alpha}, \ldots, \tilde{\alpha}}_{M-1}) \tag{45}$$

$$\tilde{\alpha} = \left(\underbrace{\frac{1}{\alpha_0}, \ldots, \frac{1}{\alpha_0}}_{\Omega}, \underbrace{\frac{1}{\alpha_1}, \ldots, \frac{1}{\alpha_1}}_{\Omega}, \ldots, \underbrace{\frac{1}{\alpha_K}, \ldots, \frac{1}{\alpha_K}}_{\Omega}\right) \tag{46}$$

Execution is made by repetitive optimization of alternately performing the gradient method of Formula (47) and flooring of Formula (48).

[Formula 41]

$$a \leftarrow a + \lambda \frac{\partial \mathcal{L}_a}{\partial a} \tag{47}$$

$$a_{1,\ldots,\Omega,1,\ldots,K}^{(2,\ldots,M)} \leftarrow \max(0, a_{1,\ldots,\Omega,1,\ldots,K}^{(2,\ldots,M)}) \tag{48}$$

Here, λ is an update step size. The number of repetitions of the gradient method, i.e., Formulae (47) and (48), is about 30 in the case of the batch learning, and about one in the case of the online learning. The gradient of Formula (44) may be adjusted using an inertial term (Reference non-patent literature 2) or the like.

(Reference non-patent literature 2: Hideki Asoh and other 7 authors, "ShinSo GakuShu, Deep Learning", Kindai kagaku sha Co., Ltd., Nov. 2015).

Formula (43) is combinatorial optimization of discrete variables. Accordingly, update is performed by grid searching. Specifically, the time frame difference update part 132 defines the possible maximum value and minimum value of $P_m$ for every in, evaluates, for every combination of the minimum and maximum for $P_m$, the likelihood function related to the time frame difference

[Formula 42]

$$\mathcal{L}_P$$

and updates $P_m$ with the combination of maximizing the function (S132). For practical use, the minimum value

[Formula 43]

$$\phi_{2,\ldots,M}^{min}$$

and the maximum value

[Formula 44]

$$\phi_{2,\ldots,M}^{max}$$

estimated from each microphone distance $\phi_{2,\ldots,M}$ are input, and the possible maximum value and minimum value for $P_m$ may be calculated therefrom. The maximum value and the minimum value of the sound source distance is to be set in conformity with the environment, and may be set to about $\phi_m^{min}=\phi_m-20$, and $\phi_m^{max}=\phi_m+20$.

The above update can be executed by a batch process of preliminarily estimating Θ using the learning data. In a case where an online process is intended, the observed signal may be buffered for a certain time period, and estimation of Θ may then be executed using the buffer.

After Θ is successfully estimated by the above update, noise may be estimated by Formula (8), and the target sound may be enhanced by Formulae (4) and (5).

The convergence determination part 133 determines whether the algorithm has converged or not (S133). As for the convergence condition, in the case of the batch learning, the determination method may be, for example, the sum of absolute values of the update amount of $a^{(m)}_{\omega,k}$, whether the learning times are equal to or more than a predetermined number (e.g., 1000 times) or the like. In the case of the online learning, dependent on the frequency of learning, the learning may be finished after a certain number of repetitions of learning (e.g., 1 to 5).

When the algorithm converges (S133Y), the convergence determination part 133 outputs the converged time frame difference and transfer function gain as noise estimation parameter Θ.

As described above, according to the noise estimation parameter learning device 1 of this embodiment, even in a large space causing a problem of the reverberation and the time frame difference, multiple microphones disposed at distant positions cooperate with each other, and the spectral subtraction method is executed, thereby allowing the target sound to be enhanced.

Embodiment 2

Figure 6:
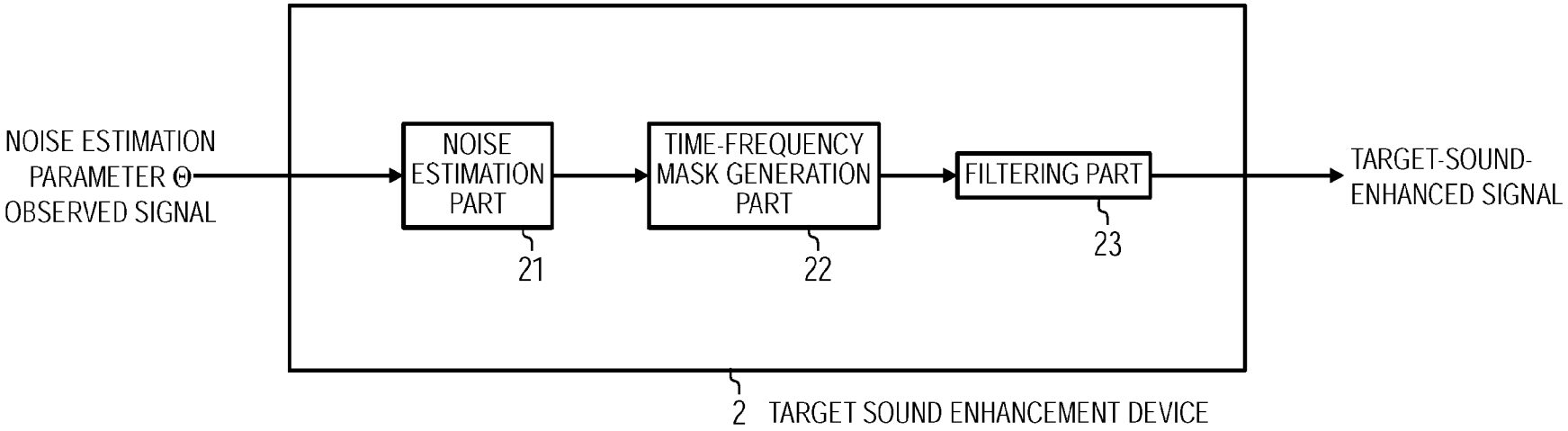
FIG. 6 is a block diagram showing a configuration of a target sound enhancement device of Embodiment 2.
Figure 7:
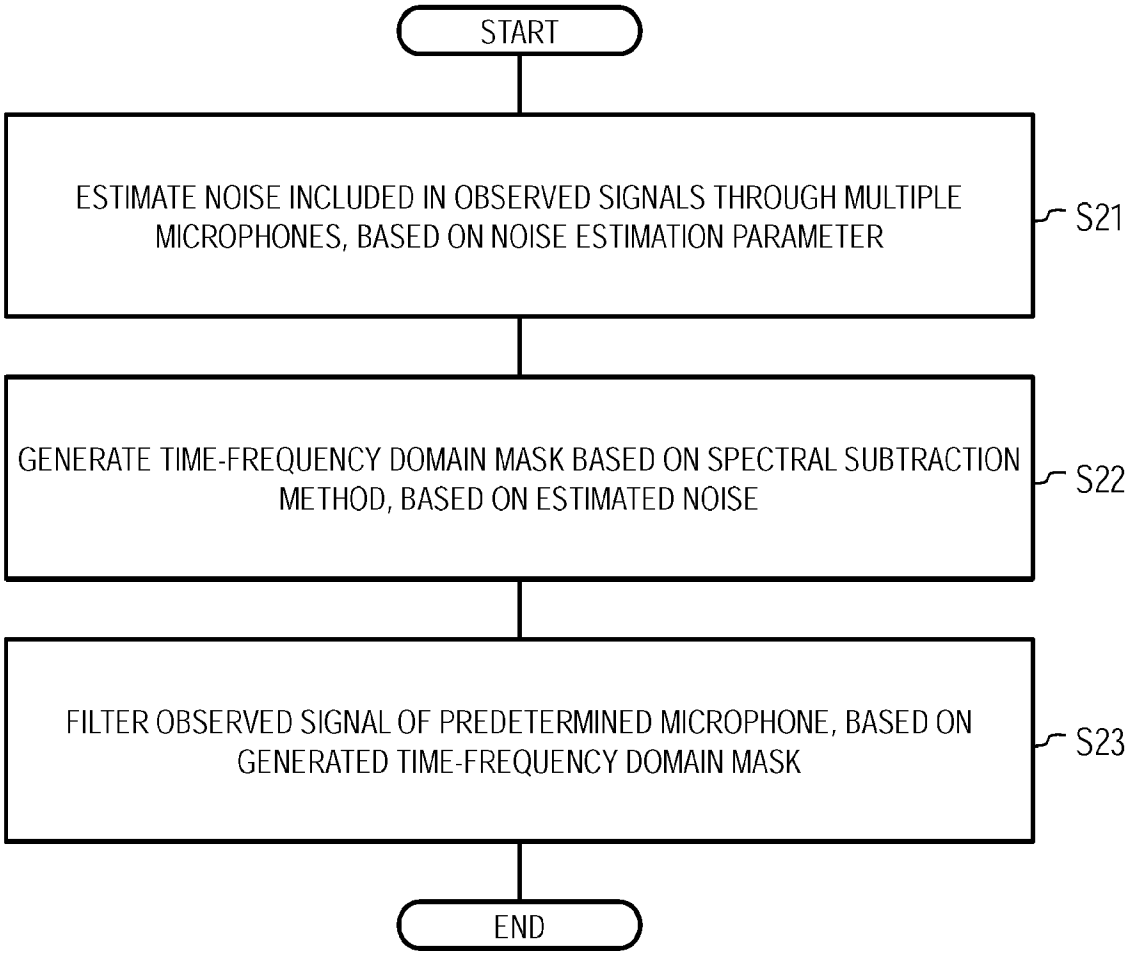
FIG. 7 is a flowchart showing an operation of the target sound enhancement device of Embodiment 2.

In Embodiment 2, a target sound enhancement device that is a device of enhancing the target sound on the basis of the noise estimation parameter Θ obtained in Embodiment 1 is described. Referring to FIG. 6, the configuration of the target sound enhancement device 2 of this embodiment is described. As shown in FIG. 6, the target sound enhancement device 2 of this embodiment includes a noise estimation part 21, a time-frequency mask generation part 22, and a filtering part 23. Hereinafter, referring to FIG. 7, the operation of the target sound enhancement device 2 of this embodiment is described.

Data required for enhancement is input into the noise estimation part 21. Specifically, the observed signal

[Formula 45]

$$X_{1,\ldots,\Omega,\tau}^{(1,\ldots,M)}$$

and the noise estimation parameter Θ are input. The observed signal may be transformed from the time waveform into the complex spectrum using a method, such as STFT. Note that, for m=M, the spectrum

[Formula 46]

$$X_{1,\ldots,\Omega,\tau-P_m-K,\ldots,\tau-P_m}^{(2,\ldots,M)}$$

buffered according to the time frame difference P, and the number of frames K of the transfer function gain are input.

The noise estimation part 21 estimates noise included in the observed signals through M (multiple) microphones on the basis of the observed signals and the noise estimation parameter Θ by Formula (8) (S21).

The noise estimation parameter Θ and Formula (8) may be construed as a parameter and formula where an observed signal from the predetermined microphone among the plurality of microphones, the time frame difference caused according to the relative position difference between the predetermined microphone, the freely selected microphone that is among the plurality of microphones and is different from the predetermined microphone and the noise source, and the transfer function gain caused according to the relative position difference between the predetermined microphone, the freely selected microphone and the noise source, are associated with each other.

The target sound enhancement device 2 may have a configuration independent of the noise estimation parameter learning device 1. That is, independent of the noise estimation parameter Co, according to Formula (8), the noise estimation part 21 may associate the observed signal from the predetermined microphone among the plurality of microphones, the time frame difference caused according to the relative position difference between the predetermined microphone, the freely selected microphone that is among the plurality of microphones and is different from the predetermined microphone and the noise source, and the transfer function gain caused according to the relative position difference between the predetermined microphone, the freely selected microphone and the noise source, with each other, and estimate noise included in observed signals through a plurality of the predetermined microphones.

The time-frequency mask generation part 22 generates the time-frequency mask $G_{\omega,\tau}$ based on the spectral subtraction method by Formula (4), on the basis of the observed signal $|X^{(1)}_{\omega,\tau}|$ of the predetermined microphone and the estimated noise $|N_{\omega,\tau}|$ (S22). The time-frequency mask generation part 22 may be called a filter generation part. The filter generation part generates a filter, based at least on the estimated noise by Formula (4) or the like.

The filtering part 23 filters the observed signal $|X^{(1)}_{\omega,\tau}|$ of the predetermined microphone on the basis of the generated time-frequency mask $G_{\omega,\tau}$ (Formula (5)), and obtains and outputs an acoustic signal (complex spectrum $Y_{\omega,\tau}$) where the sound (target sound) present adjacent to the predetermined microphone is enhanced (S23). To return the complex spectrum $Y_{\omega,\tau}$ to the waveform, inverse short-time Fourier transform (ISTFT) or the like may be used, or the function of ISTFT may be implemented in the filtering part 23.

[Modification 1]

Figure 8:
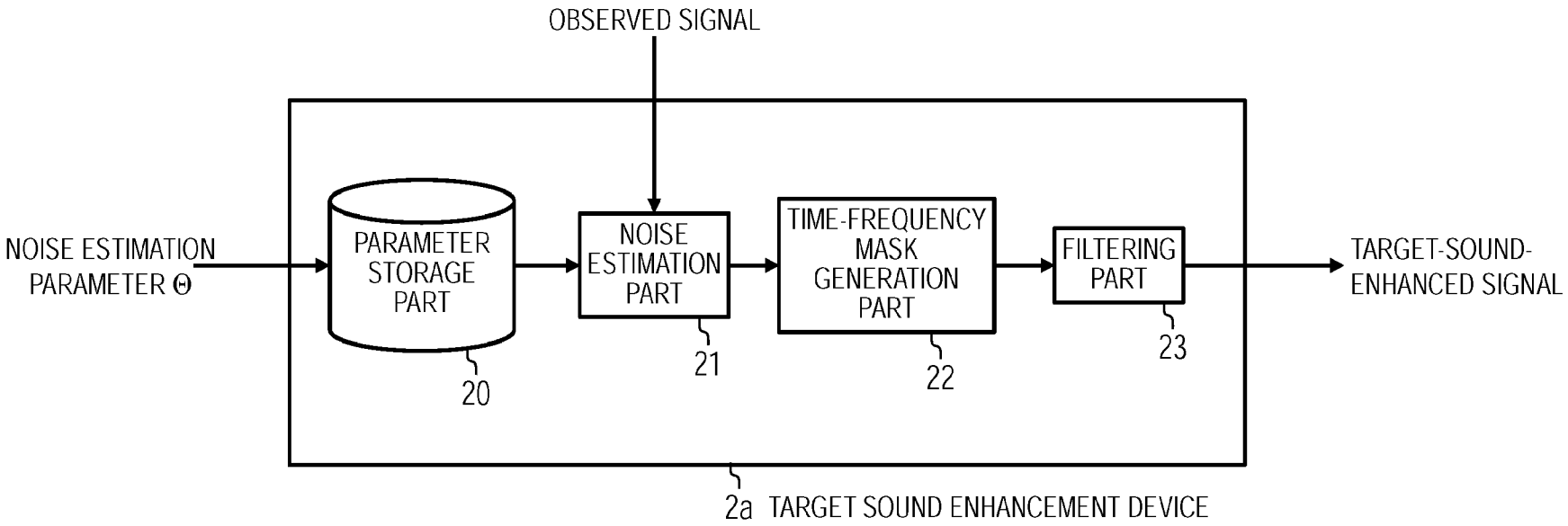
FIG. 8 is a block diagram showing a configuration of a target sound enhancement device of Modification 2.

Embodiment 2 has the configuration where the noise estimation part 21 receives (accepts) the noise estimation parameter Θ from another device (noise estimation parameter learning device 1) as required. It is a matter of course that another mode of the target sound enhancement device can be considered. For example, as a target sound enhancement device 2*a* of Modification 1 shown in FIG. 8, the noise estimation parameter Θ may be preliminarily received from the other device (noise estimation parameter learning device 1), and preliminarily stored in a parameter storage part 20.

In this case, the parameter storage part 20 preliminarily stores and holds the time frame difference and transfer function gain having been converged by alternately and repetitively updating the variables of the two likelihood functions set based on the three probability distributions described above, as the noise estimation parameter Θ.

As described above, according to the target sound enhancement devices 2 and 2*a* of this embodiment and this modification, even in the large space causing the problem of the reverberation and the time frame difference, the multiple microphones disposed at distant positions cooperate with each other, and the spectral subtraction method is executed, thereby allowing the target sound to be enhanced.

<Supplement>

The device of the present invention includes, as a single hardware entity, for example: an input part to which a keyboard and the like can be connected; an output part to which a liquid crystal display and the like can be connected; a communication part to which a communication device (e.g., a communication cable) communicable with the outside of the hardware entity can be connected; a CPU (Central Processing Unit, which may include a cache memory and a register); a RAM and a ROM, which are memories; an external storage device that is a hard disk; and a bus that connects these input part, output part, communication part, CPU, RAM, ROM and external storing device to each other in a manner allowing data to be exchanged therebetween. The hardware entity may be provided with a device (drive) capable of reading and writing from and to a recording medium, such as CD-ROM, as required. A physical entity including such a hardware resource may be a general-purpose computer or the like.

The external storage device of the hardware entity stores programs required to achieve the functions described above and data required for the processes of the programs (not limited to the external storage device; for example, programs may be stored in a ROM, which is a storage device dedicated for reading, for example). Data and the like obtained by the processes of the programs are appropriately stored in the RANI or the external storage device.

In the hardware entity, each program stored in the external storage device (or a ROM etc.), and data required for the process of each program are read into the memory, as required, and are appropriately subjected to analysis, execution and processing by the CPU. As a result, the CPU achieves predetermined functions (each component represented as . . . part, . . . portion, etc. described above).

The present invention is not limited to the embodiments described above, and can be appropriately changed in a range without departing from the spirit of the present invention. The processes described in the above embodiments may be executed in a time series manner according to the described order. Alternatively, the processes may be executed in parallel or separately, according to the processing capability of the device that executes the processes, or as required.

As described above, in a case where the processing functions of the hardware entity (the device of the present invention) described in the embodiments are achieved by a computer, the processing details of the functions to be held by the hardware entity are described in a program. The program is executed by the computer, thereby achieving the processing functions in the hardware entity on the computer.

The program that describes the processing details can be recorded in a computer-readable recording medium. The computer-readable recording medium may be, for example, any of a magnetic recording device, an optical disk, a magneto-optical recording medium, a semiconductor memory and the like. Specifically, for example, a hard disk device, a flexible disk, a magnetic tape and the like may be used as the magnetic recording device. A DVD (Digital Versatile Disc), a DVD-RAM (Random Access Memory), a CD-ROM (Compact Disc Read Only Memory), CD-R (Recordable)/RW (ReWritable) and the like may be used as the optical disk. An MO (Magneto-Optical disc) and the like may be used as the magneto-optical recording medium. An EEP-ROM (Electronically Erasable and Programmable-Read Only Memory) and the like may be used as the semiconductor memory.

For example, the program may be distributed by selling, assigning, lending and the like of portable recording media, such as a DVD and a CD-ROM, which record the program. Alternatively, a configuration may be adopted that distributes the program by storing the program in the storage device of the server computer and then transferring the program from the server computer to another computer via a network.

For example, the computer that executes such a program temporarily stores, in the own storage device, the program stored in the portable recording medium or the program transferred from the server computer. During execution of the process, the computer reads the program stored in the own recording medium, and executes the process according to the read program. Alternatively, according to another execution mode of the program, the computer may directly read the program from the portable recording medium, and execute the process according to the program. Further alternatively, every time the program is transferred to this computer from the server computer, the process according to the received program may be sequentially executed. Alternatively, a configuration may be adopted that does not transfer the program to this computer from the server computer but executes the processes described above by what is called an ASP (Application Service Provider) service that achieves the processing functions only through execution instructions and result acquisition. It is assumed that the program of this mode includes information that is to be provided for the processes by a computer and is equivalent to the program (data and the like having characteristics that are not direct instructions to the computer but define the processes of the computer).

In this mode, the hardware entity can be configured by executing a predetermined program on the computer. Alternatively, at least one or some of the processing details may be achieved by hardware.

What is claimed is:

1. A target sound enhancement device, comprising:

processing circuitry configured to implement an observed signal acquisition part that acquires observed signals from a plurality of microphones;

a frequency transformation part that transforms the observed signals into frequency spectra using a time-frame shift with a predetermined shift width;

a noise estimation part that associates (i) an observed signal from a predetermined microphone that is among the plurality of microphones and that is disposed closest to a target sound, (ii) a selected microphone that is among the plurality of microphones and that is different from the predetermined microphone, the selected microphone being disposed adjacent to a noise source (iii) a time frame difference that is caused according to an arrival-time difference between the arrival times of a noise from a noise source to the predetermined microphone and to the selected microphone, the arrival-time difference being equal to or more than the shift width and (iv) a transfer function gain caused according to the relative position difference between the predetermined microphone, the selected microphone and the noise source, with each other, and estimates noise included in observed signals through a plurality of the predetermined microphones;

a filter generation part that generates a filter based at least on the estimated noise; and a filtering part that filters the observed signal obtained from the predetermined microphone through the filter.

2. The target sound enhancement device according to claim 1, wherein the observed signal of the predetermined microphone includes a target sound and noise, and the observed signal of the selected microphone includes noise.

3. The target sound enhancement device according to claim 2, wherein the observed signal is a signal obtained by frequency-transforming an acoustic signal collected by the microphone, and a difference of two arrival times is equal to or more than a shift width of the frequency transformation, the arrival times being an arrival time of the noise from the noise source to the predetermined microphone and an arrival time of the noise from the noise source to the selected microphone.

4. The target sound enhancement device according to claim 2, wherein the noise estimation part associates, with each other, a probability distribution of observed signals of the predetermined microphone, a probability distribution where a time frame difference caused according to a relative position difference between the predetermined microphone and the selected microphone and the noise source is modeled, and a probability distribution where a transfer function gain caused according to the relative position difference between the predetermined microphone and the selected microphone and the noise source is modeled, and estimates the noise included in the observed signals through the plurality of microphones.

5. The target sound enhancement device according to claim 4, wherein the noise estimation part associates two likelihood functions set with each other based on three probability distributions and estimates the noise included in the observed signals through the plurality of microphones, the three probability distributions being a probability distribution of observed signals of the predetermined microphone, a probability distribution where a time frame difference caused according to a relative position difference between the predetermined microphone and the selected microphone and the noise source is modeled, and a probability distribution where a transfer function gain caused according to the relative position difference between the predetermined microphone and the selected microphone and the noise source is modeled, a first likelihood function being based on at least the probability distribution where the time frame difference is modelled, a second likelihood function being based on at least the probability distribution where the transfer function gain is modeled.

6. The target sound enhancement device according to claim 5, wherein the noise estimation part alternately and repetitively updates a variable of the first likelihood function and a variable of the second likelihood function.

7. The target sound enhancement device according to claim 6, wherein the variable of the first likelihood function and the variable of the second likelihood function are updated with an assigned restriction that limits the transfer function gain to a nonnegative value.

8. The target sound enhancement device according to claim 7, wherein the probability distribution of the time frame difference is modeled with a Poisson distribution, and the probability distribution of the transfer function gain is modeled with an exponential distribution.

9. A noise estimation parameter learning device for learning noise estimation parameters used to estimate noise included in observed signals through a plurality of microphones, the noise estimation parameter learning device comprising:

processing circuitry configured to implement a modeling part that models a probability distribution of observed signals of a predetermined microphone among the plurality of microphones, models a probability distribution of time frame differences caused according to a relative position difference between the predetermined microphone, a selected microphone and a noise source, and models a probability distribution of transfer function gains caused according to the relative position difference between the predetermined microphone, the selected microphone and the noise source;

a likelihood function setting part that sets a likelihood function pertaining to the time frame difference, and a likelihood function pertaining to the transfer function gain, based on the modeled probability distributions; and a parameter update part that alternately and repetitively updates a variable of the likelihood function pertaining to the time frame difference and a variable of the likelihood function pertaining to the transfer function gain, and outputs the time frame difference and the transfer function gain that have been updated, as the noise estimation parameters.

10. The noise estimation parameter learning device according to claim 9, wherein the parameter update part comprises a transfer function gain update part that assigns a restriction for limiting the transfer function gain to a nonnegative value, and repetitively updates the variable of the likelihood function pertaining to the transfer function gain by a proximal gradient method.

11. The noise estimation parameter learning device according to claim 9, wherein the modeling part comprises:

an observed signal modeling part that models the probability distribution of the observed signals with a Gaussian distribution;

a time frame difference modeling part that models the probability distribution of the time frame differences with a Poisson distribution; and a transfer function gain modeling part that models the probability distribution of the transfer function gains with an exponential distribution.

12. A target sound enhancement method executed by a target sound enhancement device, the target sound enhancement method comprising:

a step of acquiring observed signals from a plurality of microphones;

a step of transforming the observed signals into frequency spectra using a time-frame shift with a predetermined shift width;

a step of associating (i) an observed signal from a predetermined microphone that is among the plurality of microphones and that is disposed closest to a target sound, (ii) a selected microphone that is among the plurality of microphones and that is different from the predetermined microphone, the selected microphone being disposed adjacent to a noise source (iii) a time frame difference that is caused according to an arrival-time difference between the arrival times of a noise from a noise source to the predetermined microphone and to the selected microphone, the arrival-time difference being equal to or more than the shift width and (iv) a transfer function gain caused according to the relative position difference between the predetermined microphone, the selected microphone and the noise source, with each other, and of estimating noise included in observed signals through a plurality of the predetermined microphones;

a step of generating a filter based at least on the estimated noise; and a step of filtering the observed signal obtained from the predetermined microphone through the filter.

13. A noise estimation parameter learning method executed by a noise estimation parameter learning device for learning noise estimation parameters used to estimate noise included in observed signals through a plurality of microphones, the noise estimation parameter learning method comprising:

a step of modeling a probability distribution of observed signals of a predetermined microphone among the plurality of microphones, modeling a probability distribution of time frame differences caused according to a relative position difference between the predetermined microphone, a selected microphone and a noise source, and modeling a probability distribution of transfer function gains caused according to the relative position difference between the predetermined microphone, the selected microphone and the noise source;

a step of setting a likelihood function pertaining to the time frame difference, and a likelihood function pertaining to the transfer function gain, based on the modeled probability distributions; and a step of alternately and repetitively updating a variable of the likelihood function pertaining to the time frame difference and a variable of the likelihood function pertaining to the transfer function gain, and of outputting the time frame difference and the transfer function gain that have been updated, as the noise estimation parameters.

14. A non-transitory computer readable medium that stores a program causing a computer to function as the target sound enhancement device according to claim 1.

15. A non-transitory computer readable medium that stores a program causing a computer to function as the noise estimation parameter learning device according to claim 9.

* * * * *